US005240451A

United States Patent [19]

Clark, Jr.

[11] Patent Number: 5,240,451

[45] Date of Patent: Aug. 31, 1993

[54] STEERABLE TOY VEHICLE

[76] Inventor: Leonard R. Clark, Jr., 128 Weldy Ave., Oreland, Pa. 19075

[21] Appl. No.: 897,425

[22] Filed: Jun. 12, 1992

[51] Int. Cl.[5] ..... A63H 17/36

[52] U.S. Cl. ..... 446/465; 446/431

[58] Field of Search ..... 446/7, 431, 465, 468, 446/469, 450, 451

[56] References Cited

U.S. PATENT DOCUMENTS

| | | | |
|---|---|---|---|
| 1,755,483 | 4/1930 | Lundahl | 446/468 |
| 2,216,497 | 10/1940 | McHenry | 446/468 X |
| 2,386,745 | 7/1944 | Yarbrough . | |
| 2,501,206 | 3/1950 | Brackett, Jr. . | |
| 2,642,700 | 6/1953 | Zimmer | 446/468 |
| 2,730,837 | 1/1956 | Vaughan . | |
| 2,887,778 | 6/1959 | Carter . | |
| 2,946,153 | 6/1960 | Ernst | 446/468 |
| 3,188,770 | 6/1965 | Nyc . | |
| 3,590,526 | 7/1971 | Deyerl . | |
| 3,633,307 | 1/1972 | Stevber et al. | 446/468 |
| 3,696,554 | 10/1972 | Dorn . | |
| 4,187,637 | 2/1980 | Nielsen . | |
| 4,317,307 | 3/1982 | Conry . | |
| 4,595,380 | 6/1986 | Magers | 446/468 X |
| 5,000,716 | 3/1991 | Canavesi | 446/468 |

FOREIGN PATENT DOCUMENTS

| | | | |
|---|---|---|---|
| 2130904 | 6/1984 | United Kingdom | 446/469 |

*Primary Examiner*—Robert A. Hafer
*Assistant Examiner*—Sam Rimell
*Attorney, Agent, or Firm*—Michael M. de Angeli

[57] ABSTRACT

A toy vehicle comprises a chassis having a pair of rear wheels journaled for rotation about a rigid axle and a pair of front wheels mounted for being steered cooperatively. A steering mechanism is controlled by a steering wheel at the end of a steering column connected to the steering mechanism by a universal joint. A child playing with the vehicle can propel the vehicle forward by pushing on the steering wheel, but can only steer it in a desired direction of travel by turning the steering wheel.

19 Claims, 2 Drawing Sheets

STEERABLE TOY VEHICLE

BACKGROUND OF THE INVENTION

1. Field of the Invention

This invention relates to an improved toy vehicle. More particularly, this invention relates to a toy vehicle with highly realistic steering action.

2. Description of the Prior Art

It is generally accepted that increasing the realism of a toy simulating an adult activity renders it more amusing for play. Thus, for example, toy vehicles which can be steered have improved "play value" over toys without steered wheels. For this reason radio controlled model cars, wherein the operator can control the speed and direction of travel of the vehicle remotely with a radio transmitter, are very popular. However, such toys are relatively costly and are also passive, i.e., the operator simply stands in one place and directs the car.

Another class of steered toy vehicles involve pushing the vehicle with a long stick or pole. In some cases the vehicle is steered simply by pushing the pole or by leaning the toy in the direction of the desired path of the toy. See for example, U.S. Pat. Nos. 2,730,837 to Vaughan, 2,501,206 to Brackett, Jr. and 4,317,307 to Conry. A somewhat more advanced device is shown in U S. Pat. No. 4,595,380 to Magers. The Magers patent shows a toy truck including a chassis having a pair of wheels which are journaled about a fixed axis at a rearward end of the chassis, and a pair of jointly steerable wheels at the forward end of the chassis. The Magers device is propelled by pushing a steering column extending upwardly from the rear of the vehicle. The steering column is rigidly connected to the chassis of the toy vehicle, so that the chassis itself is directly pivoted with respect to the direction of motion upon turning of the steering wheel. Thus, Magers' steering wheel is not connected to the front wheels; the front wheels simply pivot to follow the direction of the vehicle on the pavement and do not actually steer the vehicle. This is essentially unrealistic.

Other references relating generally to steerable toy vehicles include Dorn U.S. Pat. No. 3,696,554, Deyerl U.S. Pat. No. 3,590,526, Yarbrough U.S. Pat. No. 2,386,745, Nyc U.S. Pat. No. 3,188,770, Carter U.S. Pat. No. 2,888,778, Ernst U.S. Pat. No. 2,946,153 and Nielsen U.S. Pat. No. 4,187,637

OBJECTS AND SUMMARY OF THE INVENTION

It is therefore an object of the invention to provide a toy vehicle having substantially improved realism and correspondingly improved play value.

The toy vehicles of the prior art, particularly the Magers vehicle, could be rendered much more pleasurable if the child were required to turn a steering wheel connected to the toy vehicle so as to steer the front wheels of the toy while pushing it. Accordingly, substantial coordination would be required to control the vehicle. Such a toy would be highly realistic and accordingly would provide substantially improved play value.

It is therefore a further object of the invention to provide a toy vehicle provided with a steering wheel mounted on a steering column extending rearwardly of the vehicle and operatively connected to a steering mechanism controlling the steering of the front wheels.

According to a further object of the invention, the steering column should be connected to the steering mechanism by a flexible joint, such that the steering wheel can transmit axial force to propel the vehicle, and can transmit torque to a steering shaft controlling the steering of the forward wheels. The provision of the flexible joint permits misalignment of the steering column, preventing the child from simply pushing the vehicle along a desired path.

According to this object of the invention, the child is obliged to turn the steering wheel proportionally in order to steer the vehicle along a desired path. This requires increased physical coordination and skill, increasing the realism and play value of the toy of the invention.

The above objects of the invention and needs of the art are satisfied by the present invention of an improved toy vehicle. The vehicle has a relatively heavy chassis. Two rear wheels are mounted for independent rotation on a solid axle fixed at the rear of the chassis. Two front wheels are mounted for rotation on stub axles. The stub axles pivot about kingpin axes at the forward end of the vehicle for steering motion and are connected by a tie rod so that they are steered together. A steering shaft is journaled for rotation about a horizontal axis extending longitudinally of the chassis and is connected to the tie rod by a drag link so that rotation of the steering shaft steers the front wheels. A steering wheel is mounted on a long lightweight steering column joined to the steering shaft, preferably by a flexible universal joint or a heavy spring. Rotation of the steering wheel steers the front wheels and exertion of axial force on the steering wheel pushes the vehicle forward or pulls it rearward. However, the provision of the flexible joint between the steering column and steering shaft permits the steering column to be substantially misaligned with the steering shaft. Accordingly, a child cannot simply push the vehicle along a desired path; he is obliged to steer the vehicle by turning the steering wheel.

The chassis may also be fitted with a pivot point to receive a draw bar of a corresponding toy trailer, for use either for play or to train drivers in backing trailers.

BRIEF DESCRIPTION OF THE DRAWINGS

The invention will be better understood if reference is made to the accompanying drawings, in which.

DESCRIPTION OF THE PREFERRED EMBODIMENTS

Figures 1, 2, 3, 4:
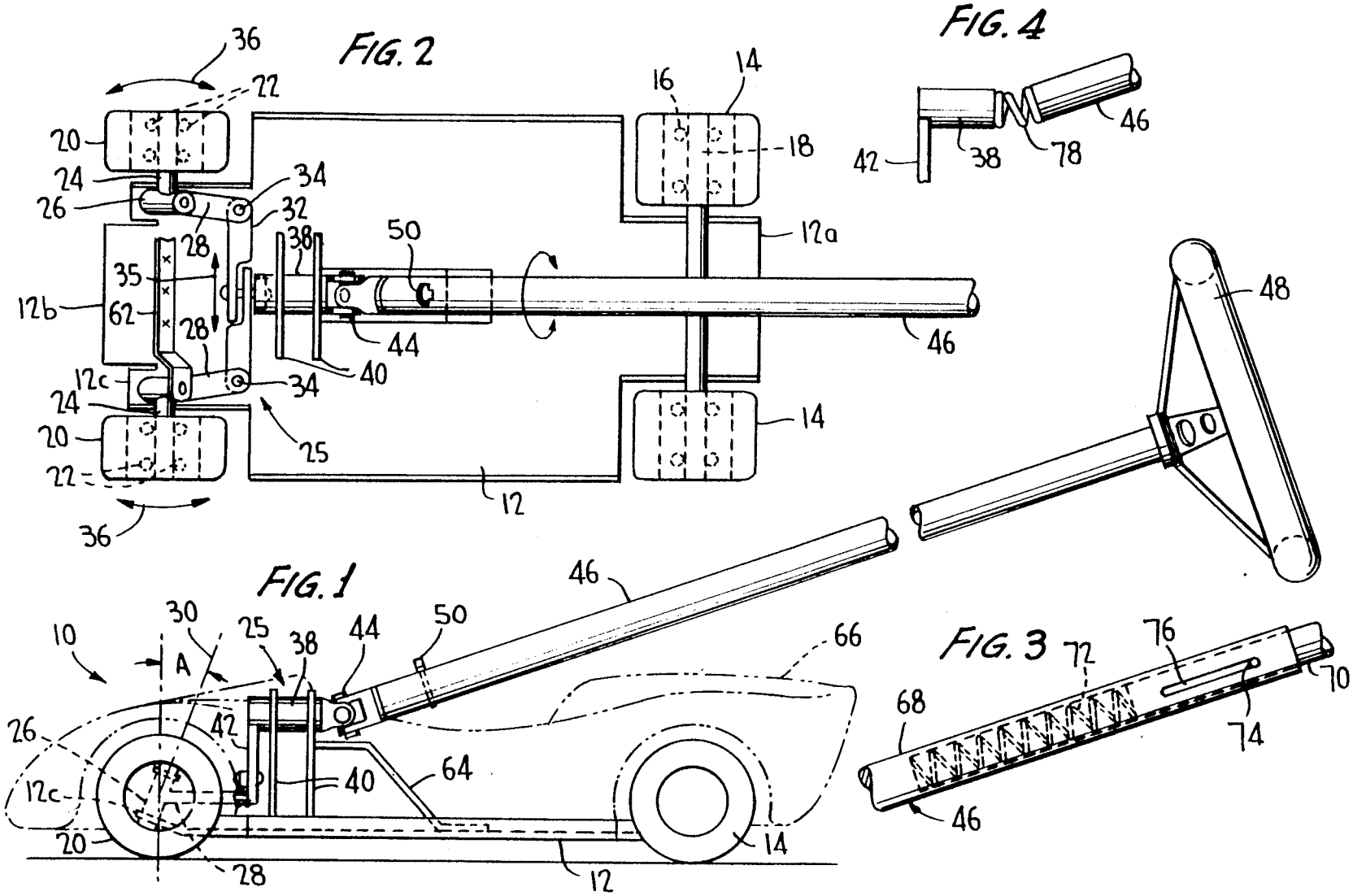
FIG. 1 is a side elevational view of a first embodiment of the toy of the invention.
FIG. 2 is a partial plan view of the toy according to the invention.
FIG. 3 is a cross-sectional view of a portion of the steering column in an alternate embodiment of the toy of the invention.
FIG. 4 is a partial side elevational view showing an alternative embodiment of a joint employed in the toy of the invention.

The toy vehicle 10 according to the invention comprises a sturdy chassis 12. A pair of rear wheels 14 are journaled by bearings 16 to a single solid rear axle 18 mounted at a rearward end 12*a* of the chassis 12.

A pair of front wheels 20 are journaled on bearings 22 for free rotation on stub axles 24 mounted at the forward end 12*b* of the chassis 12. A steering mechanism 25 ensures that the front wheels 20 are steered together. More particularly, the stub axles 24 are welded or otherwise fixed to kingpins 26. Kingpins 26 pivot about substantially parallel kingpin axes 30 preferably forming a substantial caster angle A of up to about 20° with respect to the vertical, to provide a realistic self-centering "feel" to the steering when the vehicle is being pushed forward. See FIG. 1. Steering arms 28 fixed to the kingpins 26 are connected by a tie rod 32 at pivoted connections 34. Tie rod 32 may desirably be formed of two separate members as indicated in FIG. 2. Accordingly, by moving the tie rod 32 transversely with respect to the chassis 12, as indicated by arrow 35, the steering arms 28 cause the kingpins 26 to rotate about the kingpin axes 30, thus steering the front wheels 20 concurrently as indicated by arrows 36.

The transverse motion of the tie rod 32 is controlled by rotation of a steering shaft 38 journaled in bearing mounts 40 for rotation about a generally horizontal axis extending along the longitudinal center line of the chassis 12. The steering shaft 38 is connected by a downwardly depending drag link 42 to the tie rod 32. This arrangement may be replaced by rack-and-pinion or worm-and-sector steering gear, or other known steering systems.

In the preferred embodiment, the steering shaft 38 is connected by a universal joint 44 to a lightweight steering column 46 to which is attached a steering wheel 48. To give the reader an idea of the scale, the overall length of the toy vehicle 10 may be on the order of twenty inches, the length of the steering column 46 on the order of five feet and the diameter of steering wheel 48 ten inches. Thus, a child can walk or run behind the vehicle 10, holding the steering wheel 48 at about waist level, and turning it to steer the vehicle.

It will be appreciated that by connecting the steering column 46 to the steering shaft 38 by universal joint 44, a child can push the vehicle 10 forward or pull it rearward by exerting axial force on the steering column, and can steer the vehicle by turning steering wheel 48 and accordingly steering front wheels 20, but cannot simply direct the vehicle 10 along a desired path by pushing the steering wheel in that direction. That is, the provision of the universal joint 44 will prevent axial force from being transmitted to the vehicle other than substantially directly along the axis of the steering shaft 38. Instead the child must rotate the steering wheel 48 to cause the steering wheels 20 to steer the vehicle 10 along its desired path.

The steering column 46 ma be readily detached from the universal joint 44 by removal of a spring-loaded locking "pip" pin 50 extending through aligned bores therein, to simplify shipping and storage of the toy vehicle.

As indicated in FIGS. 1 and 2 the kingpins 26 may conveniently be mounted between upturned ears 12*c* formed on forward lateral corners of the chassis 12, and an upper kingpin bracket 62 spot welded to the chassis.

A heavy brace 64 is provided to brace the journals 40 supporting the steering shaft 38 against substantial axial forces encountered during play. Similarly, the chassis 12 should be of durable construction, preferably pressed out of a sheet of steel of substantial gauge.

As shown in FIG. 1 in phantom, the vehicle of the invention 10 may be fitted with a attractive body 66 emulating a sports racing car or the like. The body could economically be formed by blow molding in inexpensive plastic material.

FIG. 3 shows an alternative embodiment of the steering column 46, wherein the steering column comprises a lower section 68 and an upper section 70. The upper section 70 is received telescopically within the lower section 68 and is urged outwardly with respect thereto by a heavy compression spring 72. The relative travel of the upper section 70 with respect to lower section 68 is limited by a pin 74 in the upper section 70 sliding within a slot 76 formed on the lower section 68. In this way if a child running behind the vehicle 10 crashes it into a tree or the like, abruptly stopping the vehicle, the steering column can collapse while the spring 72 absorbs the energy of the child's motion, reducing or preventing injury due to impact on the steering wheel.

FIG. 4 shows an alternative embodiment of the flexible joint, wherein a short coil spring 78 is interposed between the steering column 46 and the steering shaft 38. The spring 78 similarly permits transmission of axial force to propel the vehicle and torque to steer it, but does not allow one to steer the vehicle simply by pushing the steering column 46 in the intended direction of travel.

Figure 5:
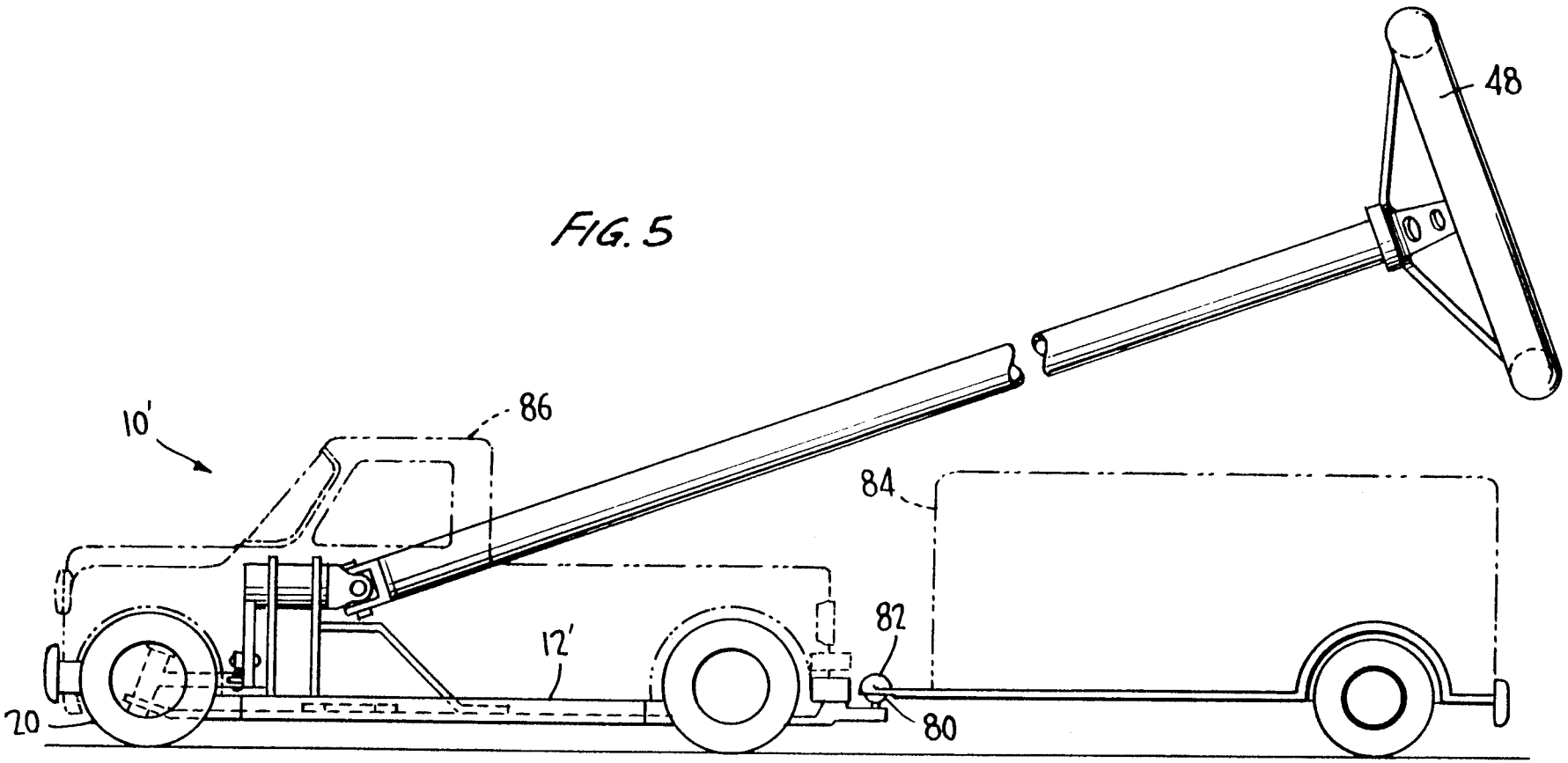
FIG. 5 is a side elevational view corresponding to FIG. 1 showing a somewhat different embodiment of the invention.

FIG. 5 shows a further embodiment of the toy vehicle 10' of the invention, wherein the chassis 12' is extended rearwardly and fitted with a pivot 80 for receiving a trailer draw bar 82 affixed to a toy trailer 84. In this embodiment it may be desirable to form the body of the toy 10' to resemble a pickup truck, highway truck tractor or the like as shown. Thus, for either play or training purposes, the vehicle 10' can be arranged to tow a trailer 84. Specifically, the toy of the invention in this embodiment may be useful in training drivers in backing with trailers, something which is often difficult to do with a full sized vehicle. In particular, the fact that according to the invention the steering of the toy vehicle 10' must be accomplished by turning the steering wheel 48 to steer the front wheels 20 will require that one attempting to back the trailer 84 into a specific location will be required to carefully coordinate his steering movements and cannot simply drag the toy in the desired direction.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A toy vehicle, comprising:

a chassis, having a forward end and a rearward end;

a pair of rear wheels mounted on said rearward end of said chassis for rotation about an axis transverse to said chassis;

a pair of front wheels mounted on stub axles at said forward end of said chassis;

a pair of kingpins mounted to said chassis for pivoting about substantially parallel kingpin axes at opposed lateral positions on said forward end of said chassis, said parallel kingpin axes being inclined at a caster angle to the vertical, said stub axles being mounted to said kingpins;

a tie rod extending transversely across said chassis and pivotally connected to said kingpins at left and right ends thereof, whereby said kingpins pivot together to steer said front wheels;

a steering mechanism comprising a rotatable steering shaft and means for converting rotational motion of said steering shaft to transverse motion of said tie rod;

a steering column attached to said steering shaft by a flexible joint allowing transmission of torque from said steering column to said steering shaft while permitting substantially free variation of the alignment of said steering column with respect to said steering shaft; and a steering wheel attached to said steering column.

2. The vehicle of claim 1, wherein said joint attaching said steering column to said steering shaft is a universal joint allowing pivoting of said steering column with respect to said steering shaft.

3. The vehicle of claim 1, further comprising means for permitting ready removal and reattachment of said steering column from said steering shaft.

4. The vehicle of claim 1, wherein said joint attaching said steering column to said steering shaft comprises a coil spring attached at opposed ends to said steering column and said steering shaft.

5. The vehicle of claim 1 wherein said kingpins comprise trailing links fixed with respect to said stub axles whereby said kingpins are pivotally connected to said tie rod.

6. The vehicle of claim 1, wherein said caster angle is between 0° and about 20°.

7. The vehicle of claim 1, wherein said means for converting rotational motion of said steering shaft to transverse motion of said tie rod comprises a drag link fixed at one end thereof to said steering shaft and pivotally coupled at an opposed end thereof to said tie rod.

8. The vehicle of claim 1, wherein said steering shaft is journaled with respect to said chassis for rotation about a substantially horizontal axis extending longitudinal of said chassis.

9. The vehicle of claim 1, wherein said chassis comprises a substantially planar member formed to comprise lower pivot points for said kingpins.

10. The vehicle of claim 9, further comprising a member assembled to said chassis comprising upper pivot points for said kingpins.

11. The vehicle of claim 1, further comprising a steering shaft mount assembled to said chassis and defining journals for receiving said steering shaft.

12. The vehicle of claim 11, wherein said steering shaft mount is braced to absorb longitudinal loading imparted to said chassis by axial thrust on said steering column.

13. The vehicle of claim 1, wherein said steering column comprises first and second axially aligned sections joined to one another by means allowing transmission of torque therebetween and permitting relative axial telescoping movement thereof.

14. The vehicle of claim 13, wherein said steering column further comprises a spring biasing said first and second sections of said steering column axially outwardly with respect to one another, so as to restore said steering column to a nominal length after compression of said spring.

15. The vehicle of claim 1, further comprising means for defining a substantially vertical pivot axis near the rearward end of said chassis for cooperative pivoting connection of a trailing toy vehicle to said chassis.

16. A toy vehicle, comprising:

a chassis, comprising a generally planar member having a forward end and a rearward end;

a pair of rear wheels mounted on an axle journaled for rotation about a transverse axis at the rearward end of said chassis;

a pair of front wheels mounted for rotation on stub axles, said stub axles pivoted for steering movement about kingpin axes at the forward end of said chassis;

a tie rod pivotally joining said stub axles for steering said front wheels by collectively pivoting said stub axles about said kingpin axes;

a steering shaft mounted for rotation about an axis extending longitudinally with respect to said chassis, and connected to said tie rod by linkage for converting rotation of said steering shaft to transverse motion of said tie rod; and a steering wheel fixed to a first end of a rigid steering column, a second end of said steering column being connected to said steering shaft by a flexible joint permitting transmission of torque and axial force from said steering wheel to said steering shaft while permitting substantially free variation of alignment of said steering column with respect to said steering shaft;

whereby an operator may push said vehicle forwardly or pull said vehicle rearwardly by exerting axial force on said steering wheel, and may steer said vehicle along a desired path only by rotating said steering wheel to steer said front wheels thereof.

17. The vehicle of claim 16, wherein said joint connecting said steering column and said steering shaft is a universal joint.

18. The vehicle of claim 16, wherein said joint connecting said steering column and said steering shaft is a helical spring.

19. The vehicle of claim 16, further comprising means for defining a substantially vertical pivot axis at the rearward end of said chassis for cooperative pivoting connection of a trailing toy vehicle to said chassis.

* * * * *